US010926531B2

(12) United States Patent
Chung

(10) Patent No.: US 10,926,531 B2
(45) Date of Patent: Feb. 23, 2021

(54) VERTICAL DOUBLE-SIDED ROTARY SCREEN TRANSFER PRINTING APPARATUS

(71) Applicants: Newtech Textile Technology Development (Shanghai) Co., LTD, Shanghai (CN); Po-Wen Chung, Shanghai (CN)

(72) Inventor: Po-Wen Chung, Shanghai (CN)

(73) Assignee: NEWTECH TEXTILE TECHNOLOGY DEVELOPMENT (SHANGHAI) CO., LTD, Shanghai (CN)

( * ) Notice: Subject to any disclaimer, the term of this patent is extended or adjusted under 35 U.S.C. 154(b) by 0 days.

(21) Appl. No.: 16/618,868

(22) PCT Filed: May 28, 2018

(86) PCT No.: PCT/CN2018/088727
§ 371 (c)(1),
(2) Date: Dec. 3, 2019

(87) PCT Pub. No.: WO2019/001198
PCT Pub. Date: Jan. 3, 2019

(65) Prior Publication Data

US 2020/0086627 A1 Mar. 19, 2020

(30) Foreign Application Priority Data

Jun. 28, 2017 (CN) ..... 201710504264.4

(51) Int. Cl.
*B41F 15/08* (2006.01)
*B41F 15/38* (2006.01)
(Continued)

(52) U.S. Cl.
CPC ..... *B41F 15/44* (2013.01); *B41F 15/06* (2013.01); *B41F 15/38* (2013.01)

(58) Field of Classification Search
CPC ..... B41F 15/06; B41F 15/38; B41F 15/44; B41F 15/08; B41F 15/10; B41F 15/12;
(Continued)

(56) References Cited

U.S. PATENT DOCUMENTS 3,915,087 A * 10/1975 Tiemann ..... B41F 15/0872 101/115
4,103,615 A * 8/1978 Cruz ..... B41F 15/0836 101/115
(Continued)

FOREIGN PATENT DOCUMENTS

CN 1235087 A 11/1999
CN 1465480 A 1/2004
(Continued)

OTHER PUBLICATIONS

International Search Report issued in application No. PCT/CN2018/088727.

*Primary Examiner* — Leslie J Evanisko
(74) *Attorney, Agent, or Firm* — McClure, Qualey & Rodack, LLP

(57) ABSTRACT

A vertical double-sided rotary screen transfer printing apparatus includes a vertical rack and one or more pair of rotary screen transfer printing assemblies horizontally disposed opposite to each other. Each rotary screen transfer printing assembly includes a rotary screen plate roller and a transfer roller arranged parallel to each other. The rotary screen plate roller transfers a pattern onto the transfer roller serving as a temporary transfer carrier. The transfer roller transfers the pattern onto a fabric passing in a vertical direction between the rotary screen transfer printing assemblies opposite to each other.

18 Claims, 3 Drawing Sheets

(51) Int. Cl.
*B41F 15/40* (2006.01)
*B41F 15/44* (2006.01)
*B41F 15/06* (2006.01)

(58) Field of Classification Search
CPC ..... B41F 15/14; B41F 15/40; B41F 15/42; B41F 15/46; B41M 1/12
USPC ..... 101/219
See application file for complete search history.

(56) References Cited

U.S. PATENT DOCUMENTS 4,436,032 A * 3/1984 van Ouwerkerk .... B41F 35/004 101/120
5,375,516 A * 12/1994 Hasegawa ..... B41L 13/04 101/115
5,782,182 A * 7/1998 Rucknnann ..... B41F 7/12 101/177
6,085,651 A 7/2000 Defrance et al.
6,655,270 B2 * 12/2003 Schaede ..... B41F 15/0809 101/114
2006/0107853 A1 5/2006 Goettling et al.
2008/0168915 A1 * 7/2008 Chung ..... B41F 16/02 101/217
2009/0193991 A1 * 8/2009 Rossini ..... B41N 10/04 101/453

FOREIGN PATENT DOCUMENTS

CN 1762702 A 4/2006
CN 201249560 Y * 6/2009
CN 101734003 A 6/2010
CN 202357579 U 8/2012
CN 205112630 U 3/2016
DE 102011089185 A1 6/2013

* cited by examiner

VERTICAL DOUBLE-SIDED ROTARY SCREEN TRANSFER PRINTING APPARATUS

BACKGROUND

Technical Field

The instant disclosure relates to printing and dyeing machinery applied to the textile industry, and in particular to, a vertical double-sided rotary screen transfer printing apparatus.

Related Art

There are various printing and dyeing processes and a wide variety of machinery. At present, main printing processes on the market include screen printing, roller printing, platen printing, transfer printing, and digital inkjet printing. Corresponding devices mainly include rotary screen printing machines, flat screen printing machines, roller printing machines, platen printing machines, transfer printing machines, and digital inkjet printing machines, etc.

The rotary screen printing machine was initiated by the Stork Company in 1963. Although its history is not long, the rotary screen printing machine has developed rapidly, which has the advantages of low labor intensity, high production efficiency, and strong adaptability to fabrics. The rotary screen printing machine is suitable for printing chemical fiber fabrics, knitted fabrics, and light fabrics, so that an effect of vivid pattern types and bright colors can be obtained, and a defect of color transfer can be avoided. Therefore, in the past two or three decades, the rotary screen printing machine has become a mainstream product for textile printing, and has been widely used in printing production in China. Since the introduction of the rotary screen printing machine into China in 1973, the original roller printing machine is gradually replaced with the rotary screen printing machine. Because of the use of the rotary screen, the production efficiency is improved, costs are reduced, and operational labor intensity is reduced, so that the rotary screen printing machine is very popular in printing enterprises and also promotes technological progress of domestic rotary screen printing machines.

Transfer printing is one of current textile printing processes developed relatively rapidly. Transfer printing was begun in the late 1960s. Early transfer printing mainly adopted a heat transfer printing process, that is, a printing method in which a certain dye is first printed on other materials such as paper, and then the pattern is transferred to the fabric through hot pressing or the like. In recent years, in addition to heat transfer printing, cold transfer printing has been developed rapidly. Cold transfer printing is to use a water-based color paste to print a pattern onto a piece of coated paper, to transfer the pattern to the fabric at room temperature, to develop the color through a cold pile or steaming, and finally to wash the pattern to remove the floating color, thereby completing an entire printing process. Transfer printing has the imitation digital printing quality and may be produced in high volumes, of which costs are much lower than that of digital printing, and therefore the market prospect is broad.

A problem existing in the prior art is that the rotary screen printing machine is limited by the rotary screen structure, and an effect of printing fine lines is not very satisfactory. Consumption of transfer paper in the transfer printing machine becomes an obstacle to green production, and paperless transfer printing technologies and devices also begin to be developed on the market.

Furthermore, in the field of transfer printing, either heat transfer printing or cold transfer printing mostly uses gravure as a plate roller for printing to reflect the characteristic of line fineness. However, some companies applied the rotary screen to the field of transfer printing and also made attempts before commercial production. For example, in the technical solution disclosed in the China patent publication (CN1324418A), "Pattern carrier used in the transfer method, and application of amorphous syrup to the dispersion liquid of the coated paper for obtaining the carrier", in Embodiments 1, 3, and 4 of the publication, a Stock RT printing and dyeing machine is used, the printing paper is transferred through rotary screen printing and then used for transfer printing. However, the rotary screen printing machine for printing is used to print paper, though the publication adopts the advantage that the rotary screen relative to an intaglio plate has a large amount of ink, printing fineness of the rotary screen is inferior to that of the intaglio plate.

SUMMARY

Therefore, the instant disclosure is to provide a vertical double-sided rotary screen transfer printing apparatus, which is capable of resolving solving the foregoing problems in the prior art.

According to one aspect of the instant disclosure, a vertical double-sided rotary screen transfer printing apparatus is provided, including a vertical rack and at least one pair of rotary screen transfer assemblies horizontally disposed opposite to each other. Each of the rotary screen transfer assemblies includes a rotary screen plate roller and a transfer roller arranged in parallel with each other, the rotary screen plate roller transfers a pattern onto the transfer roller as a temporary transfer carrier, and the transfer roller transfers the pattern onto a fabric passing in a vertical direction between the rotary screen transfer assemblies arranged opposite to each other.

Preferably, the rotary screen plate roller and the transfer roller in each of the rotary screen transfer assemblies are mounted on a sliding apparatus in a bracket outer frame of the rotary screen transfer assembly. Each of the rotary screen transfer assemblies further includes a rotary screen transfer assembly pressure application cylinder, so that each pair of the rotary screen transfer assemblies oppositely disposed moves laterally toward each other, and the transfer roller in each pair of the rotary screen transfer assemblies forms a pressure contact.

Preferably, in each pair of the rotary screen transfer assemblies oppositely disposed, one of the rotary screen transfer assemblies is fixed so as not to move laterally, and the other rotary screen transfer assembly includes a rotary screen transfer assembly pressure application cylinder for lateral movement to achieve a pressure contact between two rotary screen transfer assemblies.

Preferably, a center of each pair of the rotary screen transfer assemblies is on a same horizontal line.

Preferably, in each of the rotary screen transfer assemblies, the transfer roller or the rotary screen plate roller is driven to move laterally using an actuator to adjust a distance between the rotary screen plate roller and the transfer roller.

Preferably, a surface of the transfer roller is coated with seamless rubber or resin and has Shore hardness between 70 and 90.

Preferably, in each of the rotary screen transfer assemblies, a diameter of the transfer roller is the same as a diameter of the rotary screen plate roller, or is an integral multiple of the diameter of the rotary screen plate roller.

Preferably, a pair of drying apparatuses is provided at an exit of each pair of the rotary screen transfer assemblies, and the fabric passes between the drying apparatuses.

Preferably, the drying apparatus is an infrared dryer or a hot air dryer.

Preferably, each of the rotary screen transfer assemblies further includes a scraper assembly, the scraper assembly includes a scraper disposed in the rotary screen plate roller, and a position and a pressure of the scraper relative to the rotary screen plate roller are adjusted using a scraper adjustment mechanism.

According to the instant disclosure, the scraper adjustment mechanism includes a primary adjustment mechanism and a secondary adjustment mechanism, where the primary adjustment mechanism includes a swing arm and a swing arm actuating apparatus for actuating the swing arm. The swing arm includes a first swing arm portion and a second swing arm portion, one of two ends of the first swing arm portion is connected to the swing arm actuating apparatus, and the other end of the first swing arm portion is fixedly connected to the second swing arm portion at an angle. A pivot portion is provided on the first swing arm portion, so that the first swing arm portion is pivotable around the pivot portion when being actuated by the swing arm actuating apparatus. The pivoting of the first swing arm portion allows the second swing arm portion to move accordingly, and the movement of the second swing arm portion allows the scraper to move close to or away from an inner surface of the rotary screen plate roller. The secondary adjustment mechanism includes a secondary scraper pressure adjustment assembly and a secondary scraper position adjustment assembly, where the secondary scraper pressure adjustment assembly is arranged on the first swing arm portion for adjusting a contact pressure of the scraper and the rotary screen, and the secondary scraper position adjustment assembly is arranged on the second swing arm portion for adjusting a position of the scraper in the rotary screen.

Preferably, the secondary scraper pressure adjustment assembly includes a pressing member, and the pressing member is configured to change a force applied to an end of the first swing arm portion close to the swing arm actuating apparatus, so that the contact pressure between the scraper and the rotary screen is adjusted through making the swing arm pivot around the pivot portion.

Preferably, the secondary scraper pressure adjustment assembly further includes a pressure adjustment sliding member, where the pressure adjustment sliding member can be slidably engaged with the pressing member, and the sliding of the pressure adjustment sliding member allows the force applied to the first swing arm portion by the pressing member to change.

Preferably, the pressure adjustment sliding member has an inclined surface whose height gradually changes, and the inclined surface may be slidably engaged with an outer surface of the pressing member. When the pressure adjustment sliding member slides, because the height of the inclined surface gradually changes, the contact force between the inclined surface and the outer surface of the pressing member is changed, so that the force applied to the first swing arm portion by the pressing member is changed.

Preferably, the pressing member has a cylindrical shape.

Preferably, the pressing member is a cylindrical rolling bearing that can roll around a central axis of the rolling bearing.

Preferably, the secondary scraper pressure adjustment assembly further includes a pressure adjustment hand wheel and a pressure adjustment screw nut mechanism, the pressure adjustment hand wheel is connected to one of two ends of the pressure adjustment screw nut mechanism which is close to the second swing arm portion, and the pressure adjustment sliding member is connected to the other end of the pressure adjustment screw nut mechanism. When the pressure adjustment hand wheel is rotated, the pressure adjustment sliding member slides through the pressure adjustment screw nut mechanism.

Preferably, a cross section of the first swing arm portion is rectangular, the first swing arm portion has a hollow cavity extending along an axial direction thereof, and a slit is disposed on an upper wall of one end of the first swing arm portion which is close to the swing arm actuating apparatus, the slit extends through the upper wall and extends along an axial direction of the first swing arm portion, where the pressure adjustment sliding member passes through the slit and is located on the upper wall of the first swing arm portion, so that the pressure adjustment sliding member has a first sliding portion outside the first swing arm portion and a second sliding portion in the hollow cavity of the first swing arm portion. The inclined surface of the pressure adjustment sliding member is located on the first sliding portion, and the pressure adjustment screw nut mechanism is located in the hollow cavity of the first swing arm portion and connected to the second sliding portion in the hollow cavity of the first swing arm portion, so that the pressure adjustment sliding member can slide along a direction in which the slit extends.

Preferably, the secondary scraper position adjustment assembly further includes a position adjustment hand wheel, a position adjustment screw nut mechanism, and a position adjustment sliding member, where the position adjustment hand wheel is connected to one of two ends of the position adjustment screw nut mechanism which is away from the first swing arm portion, the position adjustment sliding member is located at the other end of the position adjustment screw nut mechanism, and the scraper assembly is connected to the position adjustment sliding member and can move together with the position adjustment sliding member.

Preferably, the secondary scraper position adjusting assembly further includes a scraper fixing hand wheel, and after the scraper is adjusted to an appropriate position using the secondary scraper position adjustment assembly, the scraper fixing hand wheel is used to fix the scraper to an adjusted location.

Preferably, the position adjustment sliding member is connected to the other end of the position adjustment screw nut mechanism.

Preferably, the position adjustment sliding member abuts against the other end of the position adjustment screw nut mechanism.

Preferably, a cross section of the second swing arm portion is rectangular, and the second swing arm portion has a hollow cavity extending along an axial direction thereof. The position adjustment sliding member and the position adjustment screw nut mechanism of the secondary scraper position adjustment assembly are both located in a hollow cavity of the second swing arm portion, a first slit is disposed on the second swing arm portion, and the scraper assembly is connected to the position adjustment slide member through the first slit.

Preferably, the second swing arm portion further includes a second slit, the second slit and the first slit are disposed on different walls of the second swing arm portion, and the scraper fixing hand wheel is threaded to the position adjustment sliding member through the second slit.

Preferably, when the scraper fixing hand wheel is loosened, the scraper fixing hand wheel, the position adjustment sliding member, and the scraper assembly can move together in a same direction. When the scraper fixing hand is tightened, the position adjustment sliding member and the scraper assembly are both fixed.

Preferably, the first swing arm portion and the second swing arm portion are formed as an integral structure.

Preferably, the first swing arm portion and the second swing arm portion are formed as separated structures.

According to the instant disclosure, alternatively, the scraper adjustment mechanism includes a swing arm and a swing arm actuating apparatus for actuating the swing arm. The swing arm includes a first swing arm portion and a second swing arm portion, one of two ends of the first swing arm portion is connected to a swing arm actuating apparatus, and the other end of the first swing arm portion is fixedly connected to the second swing arm portion at an angle. A pivot portion is disposed on the first swing arm portion, so that the first swing arm portion is pivotable around the pivot portion when being actuated by the swing arm actuating apparatus. The pivoting of the first swing arm portion allows the second swing arm portion to move accordingly, and the movement of the second swing arm portion allows the scraper to move close to or away from an inner surface of the rotary screen plate roller, thereby adjusting a position of the scraper in the rotary screen plate roller and a contact pressure between the scraper and the rotary screen plate roller.

According to the alternative scraper adjustment mechanism of the instant disclosure, an angle between the first swing arm portion and the second swing arm portion is an obtuse angle.

Based on the development of high mesh-number rotary screens in recent years and the fact that the costs of rotary screen platemaking are much lower than that of intaglio printing, the vertical double-sided rotary screen transfer printing apparatus according to the instant disclosure uses a rotary screen printing plate to print a pattern onto a transfer roller, and prints the pattern onto the fabric through the transfer roller, thereby not only reducing the platemaking costs, but also achieving paperless transfer printing.

Furthermore, the scraper adjustment mechanism used in the instant disclosure can adjust the position and the pressure of the scraper accurately, and is simple in structure, is easy to adjust, and has low costs. The scraper adjustment mechanism having the foregoing configuration adopts a two-stage adjustment manner. First, the scraper is adjusted to the appropriate position in the rotary screen plate roller using the primary adjustment mechanism; then, according to the actual needs (for example, according to the printing speed, the type of scraper used, etc.), the position of the scraper in the rotary screen plate roller and the contact pressure between the scraper and the rotary screen are more finely adjusted through the secondary scraper position adjustment assembly and the secondary scraper pressure adjustment assembly. Fine adjustment can be performed through the secondary scraper position adjustment assembly and the secondary scraper pressure adjustment assembly, so that the print quality of the rotary screen printing is improved, the wear of the scraper and the rotary screen is reduced, and the service life of the scraper and the rotary screen are extended. The secondary scraper position adjustment assembly and the secondary scraper pressure adjustment assembly having the foregoing configuration can be easily adjusted manually, which is more convenient to adjust in comparison to the prior art device. Furthermore, the secondary scraper position adjustment assembly and the secondary scraper pressure adjustment assembly are mainly arranged inside the primary adjusting mechanism, which not only reduces the space occupied by the two assemblies and facilitates the arrangement of the device, but also can protect the secondary scraper position adjustment and the secondary scraper pressure adjustment assembly from being affected or damaged by the external environment.

Other objects, features, and details of the instant disclosure will become fully apparent with reference to the following detailed description of exemplary embodiments and the accompanying drawings and in accordance with the appended claims.

A person skilled in the art should understand the advantages of the embodiments and various additional embodiments by reading the following detailed description of the embodiments with reference to the corresponding accompanying drawings listed below. In addition, various features of the accompanying drawings discussed below are not necessarily drawn to scale. Dimensions of various features and elements in the accompanying drawings may be expanded or reduced to more clearly illustrate the embodiments of the instant disclosure.

BRIEF DESCRIPTION OF THE DRAWINGS

The instant disclosure is further described with reference to the accompanying drawings and the embodiments, and a same reference label refers to similar or the same elements throughout the accompanying drawings and the descriptions of the accompanying drawings.

DETAILED DESCRIPTION

Figure 1:
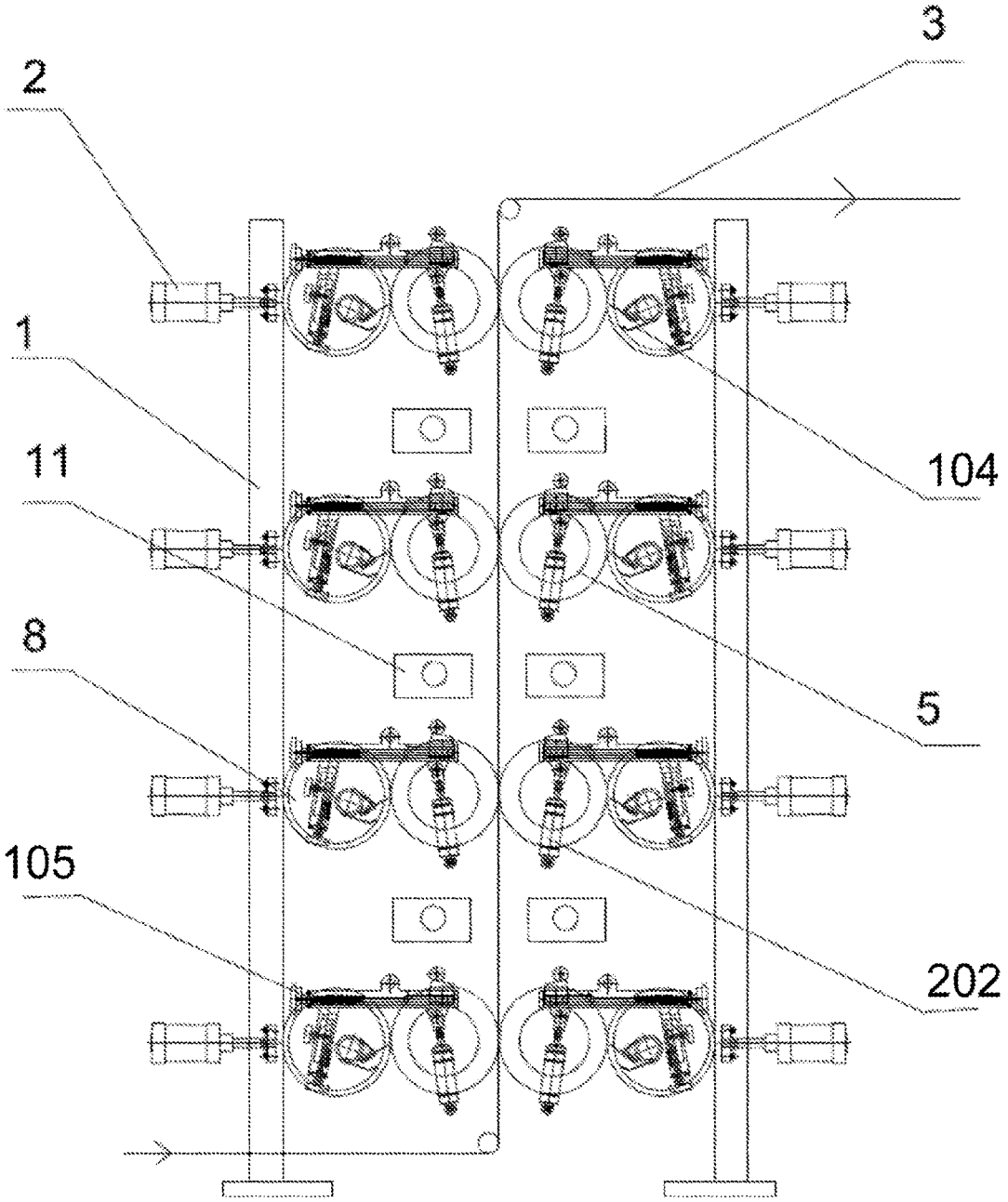
FIG. 1 is a side view of a vertical double-sided rotary screen transfer printing apparatus according to an embodiment of the instant disclosure, which is perpendicular to an axial cross-sectional view.

Various illustrative embodiments of the instant disclosure are described below. In this specification, various systems, structures, and devices are schematically depicted in the accompanying drawings for purposes of explanation only, but all features of actual systems, structures, and devices such as well-known functions or structures are not described in detail to avoid unnecessary details that obscure the instant disclosure. Certainly, it should be understood that in any practical application, many specific implementation decisions need to be made to achieve the specific goals of developers or users, the system-related and industry-related restrictions need to be followed, and the specific goals may vary according to the actual application. In addition, it should be understood that such specific implementation decisions, while complex and time consuming, are routine tasks for those of ordinary skill in the art who benefit from this application.

The terms and phrases used herein should be understood and interpreted as having a meaning consistent with the understanding of these terms and phrases by those skilled in the relevant art. The consistent usage of terms or phrases herein is not intended to imply a particular definition of terms or phrases, that is, a definition that is different from an ordinary and customary meaning understood by those skilled in the art. For terms or phrases intended to have a special meaning, that is, a meaning different from what a skilled person understands, the special definition will be explicitly listed in the specification in a defined manner, and the special definition of terms or phrases will be given directly and unequivocally.

Unless required by the content, in the entire specification and claims below, the word "include/comprise" and its variants, such as "including", are to be interpreted in an open, inclusive sense, that is, "including but not limited to".

Throughout the description of this specification, the description of the reference terms such as "an embodiment", "one embodiment", "some embodiments", "example", "specific example", or "some examples" means that the specific features, structures, materials or characteristics described with reference to the embodiment or example are included in at least one embodiment or example of the instant disclosure. Therefore, the phrase such as "in one embodiment" or "in an embodiment" that appears in different places throughout the specification does not necessarily refer to the same embodiment. Moreover, the specific features, structures, materials, or characteristics described may be combined in any one or more embodiments or examples in an appropriate manner.

As used in this specification and the appended claims, unless otherwise specified and limited, the singular form of the indefinite article "a" and the definite article "the" include one or more reference objects. It should also be noted that, unless otherwise specified and limited, the term "or" generally includes "and/or" in terms of meaning. For the purposes of explanation, a phrase in the form of "A or B" means "(A), (B) or (A and B)". For the purpose of explanation, a phrase in the form of "at least one of A, B, or C" means "(A), (B), (C), (A and B), (A and C), (B and C) or (A, B, and C)."

Moreover, the terms "first", "second", and the like are used for descriptive purposes only and are not to be construed as indicating or implying a relative importance or implicitly indicating the number of technical features indicated. Therefore, features defined by "first", "second", and the like may include one or more of the features, either explicitly or implicitly. In the description of the instant disclosure, unless otherwise specifically defined, "a plurality of" means two or more.

In the instant disclosure, unless otherwise explicitly specified or defined, the terms such as "mount", "install", "connect", "connection", and "fix" should be understood in a broad sense. For example, the connection may be a fixed connection, a detachable connection, or an integral connection; or the connection may be a mechanical connection or an electrical connection; or the connection may be a direct connection, an indirect connection through an intermediary, or internal communication between two components. Persons of ordinary skill in the art may understand the specific meanings of the foregoing terms in instant disclosure according to specific situations.

Figure 2:
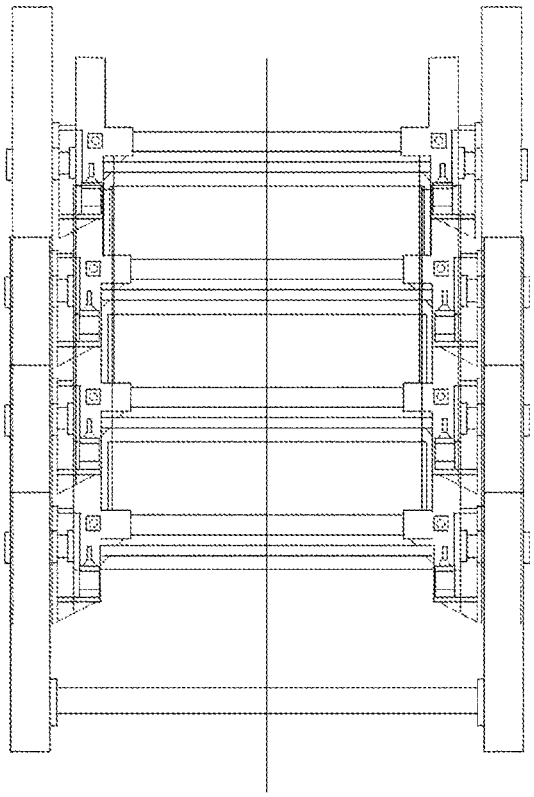
FIG. 2 is a front view of a vertical double-sided rotary screen transfer printing apparatus, which is parallel to an axial cross-sectional view.

As shown in FIGS. 1 and 2, a vertical double-sided rotary screen transfer printing apparatus of the instant disclosure includes a vertical rack 1 and at least one pair of rotary screen transfer assemblies (also referred to as print color group units) horizontally mounted opposite to each other. Each of the rotary screen transfer assemblies has a same structure, and the structure of the rotary screen transfer assembly is to be specifically described below with reference to FIG. 3. A fabric 3 passes in a vertical direction between each pair of the rotary screen transfer assemblies.

Figure 3:
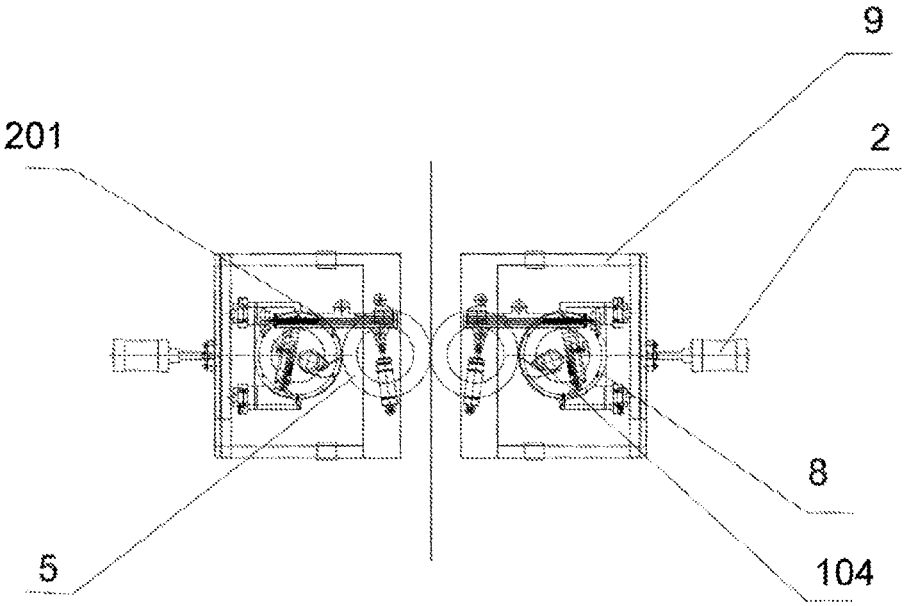
FIG. 3 is an enlarged view of a pair of rotary screen transfer assemblies of FIG. 1, which is perpendicular to an axial cross-sectional view.

FIG. 3 only shows a pair of rotary screen transfer assemblies of FIG. 1. Each of the rotary screen transfer assemblies includes a rotary screen plate roller 8 (also referred to as a rotary screen plate) and a transfer printing roller 5 (also referred to as a transfer roller) arranged in parallel with each other. Two ends of respective roller shafts of the rotary screen plate roller 8 and the transfer roller 5 are mounted on a sliding apparatus in a bracket outer frame 9 of the rotary screen transfer assembly, and the bracket outer frame 9 is mounted on a rack 1 using fasteners such as bolts. Each of the rotary screen transfer assemblies further includes a rotary screen transfer assembly pressure application cylinder 2 mounted on the bracket outer frame 9, which applies a pressure to the rotary screen transfer assembly in a direction that is in a straight line with a line-connecting axis of the rotary screen plate roller 8 and the transfer roller 5 with each other and perpendicular to the fabric 3. Under the pressure applied by the rotary screen transfer assembly pressure application cylinder 2, each pair of the rotary screen transfer assemblies are laterally moved toward each other to form a pressure contact between the transfer rollers 5 in the pair of the rotary screen transfer assemblies, thereby being capable of applying a pressure to the fabric 3 passing between the rotary screen transfer assemblies. By the way, in the foregoing manner, the transfer rollers 5 in each pair of the rotary screen transfer assemblies serve as a back-pressure roller. As another optional alternative implementation, in a pair of opposite rotary screen transfer assemblies, the rotary screen transfer assembly on one side may be fixed so as not to move laterally, but only the rotary screen transfer assembly on the other side includes a rotary screen transfer assembly pressure application cylinder 2 for lateral movement to achieve the pressure contact between two rotary screen transfer assemblies (in particular, the transfer rollers 5). In this case, fixed transfer rollers 5 in the rotary screen transfer assemblies serve as back-pressure rollers.

As described above, the vertical double-sided rotary screen transfer printing apparatus of the instant disclosure uses the transfer roller 5 in the pair of the rotary screen transfer assemblies as a temporary transfer carrier with no need to transfer printing paper, thereby reducing consumption of paper consumables.

Centers of each of the rotary screen transfer assemblies (that is, a center of a line-connecting axis of the rotary screen plate roller 8 and the transfer roller 5 with each other) are mounted perpendicular to a wall panel of the vertical rack 1, and the centers of each pair of the rotary screen transfer assemblies are on a same horizontal line.

A servo motor transmission apparatus is provided between the bracket outer frame 9 and the rotary screen plate roller 8 and the roller shaft of the transfer roller 5 to drive the rotary screen plate roller 8 and the transfer roller 5 to rotate. For example, the servo motor may drive the transfer roller 5 to rotate, and the gear drives the rotary screen plate roller 8 to rotate; or, the rotary screen plate roller 8 and the transfer roller 5 may be driven to rotate by separated servo motors.

Furthermore, in each of the rotary screen transfer assemblies, suitable actuators (for example, hydraulic cylinders, pneumatic cylinders, or electric cylinders) (not shown) are provided at two ends of the transfer roller 5, respectively, for driving the transfer roller 5 to move laterally close to or away from the rotary screen plate roller 8, to adjust a distance between the rotary screen plate roller 8 and the transfer roller 5, thereby improving an amount of ink applied to the transfer roller 5 by the rotary screen plate roller 8 and improving transfer accuracy. Alternatively, suitable actuators may be disposed at two ends of the rotary screen plate roller 8, respectively, for driving the rotary screen plate roller 8 to move laterally close to or away from the transfer roller 5, to adjust a distance between the rotary screen plate roller 8 and the transfer roller 5.

In each of the rotary screen transfer assemblies, a surface of the transfer roller 5 is coated with seamless rubber or resin, has Shore hardness between 70 and 90, and has good elasticity, fatigue resistance, and a good affinity for water-based ink, thereby being adapted to be used as the temporary transfer carrier.

Furthermore, in each of the rotary screen transfer assemblies, a diameter of the transfer roller 5 is the same as a diameter of the rotary screen plate roller 8, or is an integral multiple of the diameter of the rotary screen plate roller 8 such as 1:1, 2:1, or 3:1. In special cases, if a circumference of the rotary screen plate roller 8 is small, a ratio of the diameter of the transfer roller 5 to the diameter of the rotary screen plate roller 8 may be greater than 3:1. An integer multiple of the diameter ratio is used to achieve printing with a repeated perimeter, otherwise causing a difficulty in splicing patterns during continuous production. Usually, the diameter of the transfer roller 5 (rubber roller) is not too large, otherwise it will be heavy and easily deformed.

As shown in FIG. 1, a pair of drying apparatuses 11 is provided at an exit of each pair of rotary screen transfer assemblies, and the fabric 3 passes between the drying apparatuses 11, thereby drying transfer patterns of the fabric 3. The drying apparatus 11 may be an infrared dryer, a hot air dryer, but is preferably the infrared dryer.

Figure 4:
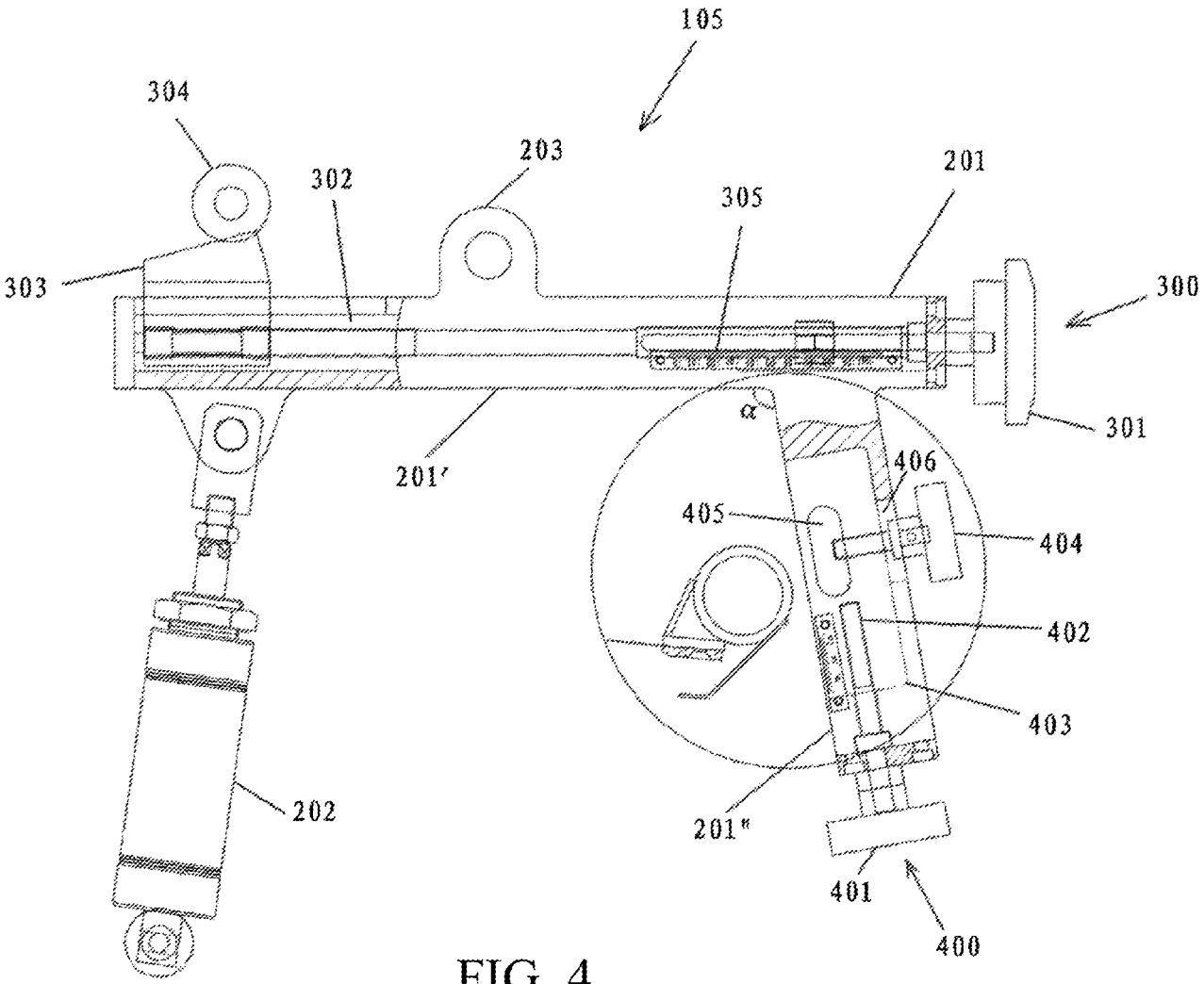
FIG. 4 is an enlarged partial cross-sectional view of a scraper adjustment mechanism shown in FIG. 1 and FIG. 3.

As shown in FIG. 1, FIG. 3, and FIG. 4, each rotary screen transfer assembly further includes a scraper assembly 104 (also referred to as a "squeegee mechanism"), the scraper assembly includes a scraper mounted on a scraper holder, and the scraper is disposed in a rotary screen plate roller 8. The scraper may be a metal scraper, a magnetic bar scraper, or a magnetic bar-scraper combined scraper. A position and a pressure of the scraper relative to the rotary screen plate roller 8 are adjusted using the scraper adjustment mechanism, thereby controlling the amount of ink.

A specific structure of a scraper adjustment mechanism 105 according to an embodiment of the instant disclosure is described below with reference to FIG. 4.

The scraper adjustment mechanism 105 includes a primary adjustment mechanism and a secondary adjustment mechanism. The primary adjustment mechanism includes a swing arm 201 and a swing arm actuating apparatus 202. The swing arm 201 is formed by two portions, a first swing arm portion 201 and a second swing arm portion 201". In the plane (that is, a paper plane) perpendicular to the axial direction of the rotary screen printing plate shown in FIG. 4, the first swing arm portion 201' is a swing arm portion that extends horizontally, and the second swing arm portion 201" is a swing arm portion that extends obliquely. One of two ends of the second swing arm portion 201" is fixed to one of two ends of the first swing arm portion 201' at an angle, and the swing arm actuating apparatus 202 is pivotally connected to the other end of the first swing arm portion 201'. An angle $\alpha$ between the first swing arm portion 201' and the second swing arm portion 201" may be selected according to an actual situation. Preferably, an angle $\alpha$ between the first swing arm portion 201' and the second swing arm portion 201" is an obtuse angle.

The first swing arm portion 201' and the second swing arm portion 201" may be formed into separate members, respectively, and then the two members are fixedly connected (for example, through welding, etc.) to form the swing arm 201. Alternatively, the first swing arm portion 201' and the second swing arm portion 201" may be formed as an integral structure. Furthermore, cross sections of the first swing arm portion 201' and the second swing arm portion 201" (that is, cross sections perpendicular to the axial direction of the swing arm portions) are preferably rectangular, so that the first swing arm portion 201' and the second swing arm portion 201" have four flat outer surfaces. However, the instant disclosure is not limited thereto, and the first swing arm portion 201' and the second swing arm portion 201" may be designed to have cross sections of other suitable shapes.

A pivot portion 203 is disposed on the first swing arm portion 201'. In the embodiment according to FIG. 4, the pivot portion 203 has a pivot hole for receiving a swing arm pivot shaft (not shown), the swing arm pivot shaft may be fixedly mounted, for example, on a frame of a printing color group unit, and the pivot hole allows the first swing arm portion 201' to rotate about the swing arm pivot shaft. An axial direction of the pivot hole is perpendicular to the paper plane shown in FIG. 4. The pivot hole may be disposed at any position between the two ends of the first swing arm portion 201' as required. Preferably, the pivot hole is disposed at a middle position close to the first swing arm portion 201'. In the embodiment shown in FIG. 4, the pivot hole is disposed in a protrusion that protrudes upward from an outer surface of the first swing arm portion 201', but the instant disclosure is not limited thereto. For example, the pivot hole may be disposed in a protrusion that protrudes rearward from the outer surface of the first swing arm portion 201'. The protrusion may be formed integrally with the first swing arm portion 201'. However, alternatively, the protrusion may be configured as a separate member, and then the protrusion is fixed to a suitable position of the first swing arm portion 201' by various ways such as welding, threaded connection, or the like. The protrusion may have any suitable shape and configuration, such as cylinder, polygon, etc. Furthermore, the pivot hole may be a through hole, or may be a blind hole as long as the blind hole can have a certain depth for receiving the pivot and can allow the swing arm 201 to rotate about the blind hole.

The scraper assembly 104 may be connected to the second swing arm portion 201" and may move together with the second swing arm portion 201".

The swing arm actuating apparatus 202 may be any type of pressure application apparatus, such as a pneumatic cylinder or a hydraulic cylinder. The swing arm actuating apparatus 202 is configured to actuate the swing arm 201 to adjust the position of the scraper assembly 104 in the rotary screen plate roller 8 through allowing the swing arm 201 to drive the scraper assembly 104 to move, thereby allowing the scraper moves close to or away from an inner surface of the rotary screen plate roller 8 in a certain orientation. The term "moves to an inner surface of the rotary screen plate roller 8" includes contact the rotary screen plate roller 8 with a certain pressure.

The process is specifically described using FIG. 4 as an example. The swing arm actuating apparatus 202 may apply a force at an end portion (that is, a connection portion of two parts) of the first swing arm portion 201', so that the end portion of the first swing arm portion 201' moves upward or downward. In this case, the first swing arm portion 201' rotates around the swing arm pivot shaft at the position of the protrusion thereof, thereby allowing the other end (that is, an end at which the first swing arm portion 201' and the second swing arm 201" are connected) of the first swing arm portion 201' to move downward or upward. The movement of the first swing arm portion 201' allows a corresponding movement of the second swing arm portion 201", thereby allowing the scraper assembly 104 to move within the rotary screen plate roller 8 through the second swing arm portion 201" until the scraper moves to a desired position.

Further, according to an embodiment of the instant disclosure, the secondary adjustment mechanism of the scraper adjustment mechanism 105 for the vertical double-sided rotary screen transfer printing apparatus includes a secondary scraper pressure adjustment assembly 300 and a secondary scraper position adjustment assembly 400. The secondary scraper pressure adjustment assembly 300 is arranged on the first swing arm portion 201' of the swing arm 201, and the secondary scraper position adjustment assembly 400 is arranged on the second swing arm portion 201" of the swing arm 201. The secondary scraper pressure adjustment assembly 300 and the secondary scraper position adjustment assembly 400 are configured to finely adjust the pressure and position of the scraper in the rotary screen plate roller 8 respectively. Preferably, the fine adjustment is performed manually, and the fine adjustment is adapted to be performed after the scraper is substantially adjusted in place by the primary adjustment mechanism, so that the position and the pressure of the scraper can be adjusted and controlled simply, thereby facilitating in improving the printing quality of the vertical double-sided rotary transfer printing apparatus and in reducing the wear of the scraper and the rotary screen.

Preferably, according to an embodiment of the instant disclosure, the first swing arm portion 201' and the second swing arm portion 201" of the swing arm 201 may each be designed to have a hollow cavity. In this way, the secondary scraper pressure adjustment assembly 300 may be disposed in the hollow cavity of the first swing arm portion 201', and the secondary scraper position adjustment assembly 400 is disposed in the hollow cavity of the second swing arm portion 201". On the one hand, with such design and arrangement manner, used materials are reduced, and a weight of the entire scraper adjustment mechanism is reduced; on the other hand, the secondary scraper pressure adjustment assembly 300 and the secondary scraper position adjustment assembly 400 are arranged inside the hollow cavity of the swing arm 201, thereby reducing space occupied in the vertical double-sided rotary transfer printing apparatus. Moreover, the secondary scraper position adjustment assembly 300 and the secondary scraper pressure adjustment assembly 400 can be protected from the external environment. However, the instant disclosure is not limited thereto, and the secondary scraper pressure adjustment assembly 300 and the secondary scraper position adjustment assembly 400 may be disposed in appropriate positions outside the swing arm 201 as needed.

The scraper pressure adjustment assembly 300 mainly includes a pressure adjustment hand wheel 301, a pressure adjustment screw nut mechanism 302, a pressure adjustment sliding member 303, and a pressing member 304. The pressure adjustment screw nut mechanism 302 extends in the axial direction of the first swing arm portion 201', and is preferably disposed inside the hollow cavity of the first swing arm portion 201'. One end (as shown in FIG. 4, the end is an end that is away from the end of the swing arm actuating apparatus 202, that is, the end close to the second swing arm portion 201") of the pressure adjustment screw nut mechanism 302 is connected to the pressure adjustment hand wheel 301, and the other end (as shown in FIG. 4, the end is an end close to the swing arm actuating apparatus 202, that is, the end away from the second swing arm portion 201") is connected to the pressure adjustment sliding member 303.

An upper wall of the first swing arm portion 201' is provided with a slit, the slit is located at one end of the first swing arm portion 201' which is close to the swing arm actuating apparatus 202, and the slit runs through the upper wall and extends a certain length along the axial direction of the first swing arm portion 201'. The pressure adjustment sliding member 303 is designed to be seated on the upper wall of the first swing arm portion 201' through the slit, and therefore is divided into two portions, that is, a first sliding portion located outside the first swing arm portion 201' and a second sliding portion located in the hollow cavity of the first swing arm portion 201'. The second sliding portion is connected to the pressure adjustment screw nut mechanism 302, so that the pressure adjustment sliding member 303 slides under the driving of the pressure adjustment screw nut mechanism 302. In this way, when the pressure adjustment hand wheel 301 is rotated, the pressure adjustment screw nut mechanism 302 is rotated, so that the pressure adjustment sliding member 303 can slide in a direction in which the slit extends in the slit.

As shown in FIG. 4, the first sliding portion of the pressure adjustment sliding member 303 has an inclined upper surface, so that a height of the first sliding portion gradually changes along the axial direction of the first swing arm portion 201'. In the embodiment shown in FIG. 4, the height of the first sliding portion gradually rises from left to right in the axial direction of the first swing arm portion 201'. However, the instant disclosure is not limited thereto. For example, the height of the first sliding portion may be designed to gradually decrease from left to right in the axial direction as needed.

The pressing member 304 is disposed above the pressure adjustment sliding member 303. Preferably, the pressing member 304 is disposed at a fixed position above the pressure adjustment sliding member 303. An inclined upper surface of the first sliding portion of the pressure adjustment sliding member 303 is used in cooperation with the pressing member 304, to adjust the contact pressure between the scraper and the rotary screen plate roller 8. In particular, firstly, the scraper is adjusted to a proper position in substantial contact with the rotary screen plate roller 8 using the primary adjustment mechanism and/or the secondary scraper position adjustment assembly 400. In this case, the pressing member 304 is close to or in contact with the inclined upper surface of the first sliding portion of the pressure adjustment sliding member 303. Then, the pressure adjustment hand wheel 301 is rotated to allow the pressure adjustment sliding member 303 to move in a desired direction. Because the height of the inclined upper surface is gradually changed, the contact pressure between the pressing member 304 and the inclined upper surface and a force applied to the first swing arm portion 201' through the inclined upper surface gradually changes, which further allowing the first swing arm portion 201' to make a small range of pivotal movement about the swing arm pivot shaft, thereby driving the scraper assembly 104 to move, and consequently changing the contact pressure between the scraper and the rotary screen plate roller 8.

In one embodiment according to the instant disclosure, the pressing member 304 has a cylindrical shape with an axial direction perpendicular to the paper plane in which FIG. 4 is located. Preferably, the pressing member 304 may be a cylindrical member (for example, a roller bearing or the like) rotatable about a central axis. In this case, because the pressing member 304 may roll on the inclined upper surface of the first sliding portion, the frictional force between the pressing member 304 and the inclined upper surface of the first sliding portion is relatively small. When the pressure adjustment is performed, the pressure adjustment sliding member 303 can be more easily slid relative to the pressing member 304, thereby reducing the force required for rotating the pressure adjustment hand wheel 301. In this way, the contact pressure between the scraper and the rotary screen can be manually adjusted more easily.

The secondary scraper pressure adjustment assembly may further include a pressure indicating element 305 for indicating a pressure adjustment amplitude. In the embodiment shown in FIG. 4, the pressure indicating element 305 includes a pressure scale and a pressure amplitude indicating element. The pressure scale is engraved with values indicating the pressure adjustment amplitudes. The pressure scale is fixed to an outer surface of the first swing arm portion 201', and to an end close to the pressure adjustment hand wheel 301. The pressure scale may be fixed to the first swing arm portion 201' in various connection manners, such as connecting using bolts, bonding, welding, and the like. The pressure amplitude indicating element is fixed to the pressure adjustment screw nut mechanism 302, and slides forward or rearward in the axial direction of the first swing arm portion 201' as the pressure adjustment screw nut mechanism 302 moves, thereby determining the pressure adjustment amplitude according to a value on the pressure scale which is indicated by the pressure amplitude indicating element. In the embodiment shown in FIG. 4, because the pressure amplitude indicating element is located inside a hollow cavity of the first swing arm portion 201', a slit extending in an axial direction of the first swing arm portion 201' is disposed at a corresponding position of the first swing arm portion 201', so that the pressure amplitude indicating element is visible. The slit has a length, in general, equal to or greater than the length of the pressure scale.

With reference to FIG. 4, a secondary scraper position adjustment assembly 400 in a scraper adjustment mechanism according to an embodiment of the instant disclosure is described in detail. After the scraper assembly 104 is substantially adjusted to the appropriate position using the primary adjustment mechanism, the scraper position is further fine-tuned using the secondary scraper position adjustment assembly 400; or the scraper position is adjusted accordingly using the secondary scraper adjustment assembly 400 when the printing speed is changed.

The secondary scraper position adjustment assembly 400 mainly includes a position adjustment hand wheel 401, a position adjustment screw nut mechanism 402, a position adjustment sliding member 403, and a scraper fixing hand wheel 404. The position adjustment screw nut mechanism 402 extends in the axial direction of the second swing arm portion 201" and is preferably disposed inside the hollow cavity of the first swing arm portion 201". One of two ends (as shown in FIG. 4, the end is an end that is away from the first swing arm portion 201') of the position adjustment screw nut mechanism 402 is connected to the position adjustment hand wheel 401, and the other end (as shown in FIG. 4, the end is an end close to the first swing arm portion 201') is connected to the position adjustment sliding member 403.

Preferably, the position adjustment sliding member 403 is slidably arranged within a hollow cavity of the second swing arm portion 201". When the position adjustment hand wheel 401 is rotated, the position adjustment screw nut mechanism 402 is rotated, so that the position adjustment sliding member 403 can slide in an axial direction of the second swing arm portion 201" in the hollow cavity of the second swing arm portion 201".

Accordingly, a first slit 405 is provided at one end of the second swing arm portion 201" which is close to the position adjustment hand wheel 401. A scraper holder of the scraper assembly 104 is connected to the position adjustment sliding member 403 through the first slit 405 in any suitable manner, thereby being capable of moving up and down with the sliding of the position adjustment sliding member 403, to change the position of the scraper relative to the rotary screen plate roller 10. A length of the first slit 405 is designed to not interfere with the movement of the scraper assembly 104, so that the scraper assembly 104 can move freely within a desired range of displacement.

A second slit 406 extending in an axial direction of the second swing arm portion 201" is further disposed on the second swing arm portion 201", and the second slit 406 and the first slit 405 are disposed on different walls of the second swing arm portion 201". The scraper fixing hand wheel 404 is screwed to the position adjustment sliding member 403 through the second slit 406. When the scraper fixing hand wheel 404 is loosened, the scraper fixing hand wheel 404 can move up and down in a direction in which the second slit 406 extends in the second slit 406. Likewise, a length of the second slit 406 is designed to not interfere with the movement of the scraper fixing hand wheel 404, so that the scraper fixing hand wheel 404 can move freely within a desired range of displacement.

When the scraper position is adjusted, firstly the scraper fixing hand wheel 404 is loosened, and then the position adjustment hand wheel 401 is manually rotated, so that the position adjustment screw nut mechanism 402 is rotated, thereby driving the position adjustment sliding member 403 to slide up and down in a hollow cavity of the second swing arm portion 201". The position adjustment sliding member 403 further drives the scraper assembly 104 to move up and down, so that the scraper is finely adjusted to a desired position. After the scraper is adjusted to the desired position, the scraper fixing hand wheel 404 is tightened, and the scraper fixing hand wheel 404, a wall portion of the second swing arm portion 201", and the position adjustment sliding member 403 are tightly pressed to each other to fix the scraper assembly 104, so that the scraper assembly 104 can no longer be moved.

According to another embodiment of the instant disclosure, the position adjustment screw nut mechanism 402 is designed to abut only against the position adjustment sliding member 403. In this embodiment, when the position adjustment hand wheel 401 is rotated in one direction (such as a clockwise direction), a length of the position adjustment screw nut mechanism 402 in the hollow cavity of the second swing arm portion is elongated, thereby pushing upward the position adjustment sliding member 403 to move along with the scraper assembly 104. When the position adjustment hand wheel 401 is rotated in an opposite direction (such as a counterclockwise direction), a length of the position adjustment screw nut mechanism 402 in the hollow cavity of the second swing arm portion is shortened. In this case, the scraper assembly 104 and the position adjustment slide member 403 are moved downward in the hollow cavity of the second swing arm portion by virtue of gravity thereof.

Optionally, the secondary scraper position adjustment assembly 400 further includes a position indicating element for indicating a position adjustment amplitude. The position indicating element may have a similar structure as the pressure indicating element 305, and is fixed to a suitable position of the second swing arm portion 201" in a similar connection manner. Details are not described herein again.

According to one embodiment of the instant disclosure, the secondary scraper position adjustment assembly 400 is capable of adjusting the position amplitude of ±10 mm. The scraper position may vary as the printing speed changes. In the case that cotton fabric printing is used as an example, when a gram weight of the cotton woven fabric is 150 g/m$^2$ and the printing speed is 60 m/min, the scraper position control hand wheel is adjusted to 0 mm; when the printing speed is increased to 80 m/min, the scraper position control hand wheel is adjusted to +4 mm; and when the printing speed is increased to 100 m/min, the scraper position control hand wheel is adjusted to +6 mm.

According to an embodiment of the instant disclosure, two scraper adjustment mechanisms 105 according to the instant disclosure may be provided at the two axial ends of the rotary screen plate roller 8. The two scraper adjustment mechanisms 105 may each have respective swing arm pivot shafts and pivot about respective pivot arms. However, the two scraper adjustment mechanisms 105 may also be coupled together by ways of a same swing arm pivot shaft, and is pivotable about the same swing arm pivot shaft. In this embodiment, preferably, each scraper adjustment mechanism 105 may be individually adjusted.

In the vertical double-sided rotary screen transfer printing apparatus of the instant disclosure, a plurality of pairs of rotary screen transfer assemblies may be mounted within a length of the rack depending on requirements for pattern colors or color overlaps, and four pairs of rotary screen transfer assemblies are preferably mounted. In this way, each pair of the rotary screen transfer assemblies performs mutual rolling during the transfer printing, there is only one rolling point between each pair of rotary screen transfer assemblies, front and back surface transfer are implemented on a same rolling point between each pair of rotary screen transfer assemblies, and front and back printing may have same precision. If the front and back surfaces are designed to have the same pattern, error-free coincidence of the front and back patterns can be achieved.

A cotton fabric is used as an example below, and a production process of the vertical double-sided rotary screen transfer printing apparatus is described as follows.

A fabric 3 is accurately positioned using a tension adjustment apparatus and a correction apparatus, and enters into the vertical double-sided rotary screen transfer printing apparatus through a guide roller. By using a separate transfer roller 5 or a rotary screen plate roller clutch cylinder, the transfer roller 5 in the rotary screen transfer assembly is controlled to be brought close to the rotary screen plate roller 8 or the rotary screen plate roller 8 is controlled to be brought close to the transfer roller 5. With a pressure applied to the rotary screen plate roller 8 by a scraper disposed in the rotary screen plate roller 8, the pattern is printed onto the transfer roller 5 as an automatic and continuous ink supply system runs. With the pressure applied by the rotary screen transfer assembly pressure application cylinder 2 to the entire rotary screen transfer assembly, the transfer rollers 5 of the rotary screen transfer assemblies are oppositely arranged to press the fabric 3 uniformly, so that the pattern can be transferred onto front and back surfaces of the fabric 3 at one time. After drying, next set of color printing is performed on a next pair of rotary screen transfer assemblies. An automatic control system feeds back a signal captured by a sensor, and controls a speed and a pressurized pressure of each rotary screen transfer assembly using a servo motor. Color patterns for the fabric 3 is completed through a plurality of pairs of rotary screen transfer assemblies (or printing color group units), and is taken out by a guide roller to enter into a subsequent step of color fixing and water washing.

The instant disclosure may include any feature, combination of features, or a summary thereof that are implicitly or explicitly disclosed herein, and is not limited to any of the limitations listed above. Any element, feature and/or structural arrangement described herein may be combined in any appropriate manner.

The specific embodiments disclosed above are exemplary only, and it is apparent to those skilled in the art who benefit from the teachings herein that the instant disclosure may be modified and implemented in a different but equivalent manner. For example, the method steps described above may be performed in a different order. In addition, the details of the structure or design shown herein are not limited except as described in the following claims. Therefore, it is apparent that changes and modifications may be made to the specific embodiments disclosed above, and all such variations are considered to fall within the scope and spirit of the instant disclosure. Therefore, the protection sought herein is set forth in the appended claims.

What is claimed is:

1. A vertical double-sided rotary screen transfer printing apparatus, comprising a vertical rack and at least one pair of rotary screen transfer assemblies horizontally disposed opposite to each other, each of the rotary screen transfer assemblies comprising a rotary screen plate roller and a transfer roller arranged in parallel with each other, the rotary screen plate roller transferring a pattern onto the transfer roller as a temporary transfer carrier, and the transfer roller transferring the pattern onto a fabric passing in a vertical direction between the transfer rollers of the rotary screen transfer assemblies arranged opposite to each other;

wherein each of the rotary screen transfer assemblies further comprises a scraper assembly, the scraper assembly comprises a scraper disposed in the rotary screen plate roller, and a position and a pressure of the scraper relative to the rotary screen plate roller are adjusted using a scraper adjustment mechanism;

wherein the scraper adjustment mechanism comprises a primary adjustment mechanism and a secondary adjustment mechanism;

wherein the primary adjustment mechanism comprises a swing arm and a swing arm actuating apparatus for actuating the swing arm, the swing arm comprises a first swing arm portion and a second swing arm portion, one of two ends of the first swing arm portion is connected to the swing arm actuating apparatus, the other end of the first swing arm portion is fixedly connected to the second swing arm portion at an angle, a pivot portion is provided on the first swing arm portion, so that the first swing arm portion is pivotable around the pivot portion when being actuated by the swing arm actuating apparatus, a pivoting of the first swing arm portion allows the second swing arm portion to move accordingly, and a movement of the second swing arm portion allows the scraper to move close to or away from an inner surface of the rotary screen plate roller; and wherein the secondary adjustment mechanism comprises a secondary scraper pressure adjustment assembly and a secondary scraper position adjustment assembly, the secondary scraper pressure adjustment assembly is arranged on the first swing arm portion for adjusting a contact pressure between the scraper and the rotary screen plate roller, and the secondary scraper position adjustment assembly is arranged on the second swing arm portion for adjusting a position of the scraper in the rotary screen plate roller.

2. The vertical double-sided rotary screen transfer printing apparatus according to claim 1, wherein the rotary screen plate roller and the transfer roller in each of the rotary screen transfer assemblies are mounted on a sliding apparatus in a bracket outer frame of the rotary screen transfer assembly, each of the rotary screen transfer assemblies further comprises a rotary screen transfer assembly pressure application cylinder, so that each pair of the rotary screen transfer assemblies oppositely disposed moves laterally toward each other, and the transfer roller in each pair of the rotary screen transfer assemblies forms a pressure contact.

3. The vertical double-sided rotary screen transfer printing apparatus according to claim 1, wherein in each pair of the rotary screen transfer assemblies oppositely disposed, one of the rotary screen transfer assemblies is fixed so as not to move laterally, and the other rotary screen transfer assembly comprises a rotary screen transfer assembly pressure application cylinder for lateral movement to achieve a pressure contact between two rotary screen transfer assemblies.

4. The vertical double-sided rotary screen transfer printing apparatus according to claim 1, wherein a center of each pair of the rotary screen transfer assemblies is on a same horizontal line.

5. The vertical double-sided rotary screen transfer printing apparatus according to claim 1, wherein in each of the rotary screen transfer assemblies, the transfer roller or the rotary screen plate roller is driven to move laterally using an actuator to adjust a distance between the rotary screen plate roller and the transfer roller.

6. The vertical double-sided rotary screen transfer printing apparatus according to claim 1, wherein a surface of the transfer roller is coated with seamless rubber or resin and has Shore hardness between 70 and 90.

7. The vertical double-sided rotary screen transfer printing apparatus according to claim 1, wherein in each of the rotary screen transfer assemblies, a diameter of the transfer roller is the same as a diameter of the rotary screen plate roller, or is an integral multiple of the diameter of the rotary screen plate roller.

8. The vertical double-sided rotary screen transfer printing apparatus according to claim 1, wherein a pair of drying apparatuses is provided at an exit of each pair of the rotary screen transfer assemblies, and the fabric passes between the drying apparatuses.

9. The vertical double-sided rotary screen transfer printing apparatus according to claim 8, wherein the drying apparatus is an infrared dryer or a hot air dryer.

10. A vertical double-sided rotary screen transfer printing apparatus, comprising a vertical rack and at least one pair of rotary screen transfer assemblies horizontally disposed opposite to each other, each of the rotary screen transfer assemblies comprising a rotary screen plate roller and a transfer roller arranged in parallel with each other, the rotary screen plate roller transferring a pattern onto the transfer roller as a temporary transfer carrier, and the transfer roller transferring the pattern onto a fabric passing in a vertical direction between the transfer rollers of the rotary screen transfer assemblies arranged opposite to each other;

wherein each of the rotary screen transfer assemblies further comprises a scraper assembly, the scraper assembly comprises a scraper disposed in the rotary screen plate roller, and a position and a pressure of the scraper relative to the rotary screen plate roller are adjusted using a scraper adjustment mechanism;

wherein the scraper adjustment mechanism comprises a swing arm and a swing arm actuating apparatus for actuating the swing arm, the swing arm comprises a first swing arm portion and a second swing arm portion, one of two ends of the first swing arm portion is connected to the swing arm actuating apparatus, and the other end of the first swing arm portion is fixedly connected to the second swing arm portion at an angle; and wherein a pivot portion is disposed on the first swing arm portion, so that the first swing arm portion is pivotable around the pivot portion when being actuated by the swing arm actuating apparatus, a pivoting of the first swing arm portion allows the second swing arm portion to move accordingly, and a movement of the second swing arm portion allows the scraper to move close to or away from an inner surface of the rotary screen plate roller, thereby adjusting a position of the scraper in the rotary screen plate roller and a contact pressure between the scraper and the rotary screen plate roller.

11. The vertical double-sided rotary screen transfer printing apparatus according to claim 10, wherein the rotary screen plate roller and the transfer roller in each of the rotary screen transfer assemblies are mounted on a sliding apparatus in a bracket outer frame of the rotary screen transfer assembly, each of the rotary screen transfer assemblies further comprises a rotary screen transfer assembly pressure application cylinder, so that each pair of the rotary screen transfer assemblies oppositely disposed moves laterally toward each other, and the transfer roller in each pair of the rotary screen transfer assemblies forms a pressure contact.

12. The vertical double-sided rotary screen transfer printing apparatus according to claim 10, wherein in each pair of the rotary screen transfer assemblies oppositely disposed, one of the rotary screen transfer assemblies is fixed so as not to move laterally, and the other rotary screen transfer assembly comprises a rotary screen transfer assembly pressure application cylinder for lateral movement to achieve a pressure contact between two rotary screen transfer assemblies.

13. The vertical double-sided rotary screen transfer printing apparatus according to claim 10, wherein a center of each pair of the rotary screen transfer assemblies is on a same horizontal line.

14. The vertical double-sided rotary screen transfer printing apparatus according to claim 10, wherein in each of the rotary screen transfer assemblies, the transfer roller or the rotary screen plate roller is driven to move laterally using an actuator to adjust a distance between the rotary screen plate roller and the transfer roller.

15. The vertical double-sided rotary screen transfer printing apparatus according to claim 10, wherein a surface of the transfer roller is coated with seamless rubber or resin and has Shore hardness between 70 and 90.

16. The vertical double-sided rotary screen transfer printing apparatus according to claim 10, wherein in each of the rotary screen transfer assemblies, a diameter of the transfer roller is the same as a diameter of the rotary screen plate roller, or is an integral multiple of the diameter of the rotary screen plate roller.

17. The vertical double-sided rotary screen transfer printing apparatus according to claim 10, wherein a pair of drying apparatuses is provided at an exit of each pair of the rotary screen transfer assemblies, and the fabric passes between the drying apparatuses.

18. The vertical double-sided rotary screen transfer printing apparatus according to claim 17, wherein the drying apparatus is an infrared dryer or a hot air dryer.

* * * * *